US006715986B2

(12) United States Patent
Takei

(10) Patent No.: US 6,715,986 B2
(45) Date of Patent: Apr. 6, 2004

(54) FUEL PUMP

(75) Inventor: Hiroaki Takei, Kariya (JP)

(73) Assignee: Denso Corporation (JP)

( * ) Notice: Subject to any disclaimer, the term of this patent is extended or adjusted under 35 U.S.C. 154(b) by 90 days.

(21) Appl. No.: 10/098,043

(22) Filed: Mar. 15, 2002

(65) Prior Publication Data

US 2002/0131860 A1 Sep. 19, 2002

(30) Foreign Application Priority Data

Mar. 19, 2001 (JP) ..... 2001-078095

(51) Int. Cl.[7] ..... F04D 5/00
(52) U.S. Cl. ..... 415/55.4
(58) Field of Search ..... 415/55.4, 55.1, 415/55.2, 55.6

(56) References Cited

U.S. PATENT DOCUMENTS 5,336,045 A 8/1994 Koyama et al.

5,765,992 A * 6/1998 Muramatsu et al. ..... 415/55.1

* cited by examiner

*Primary Examiner*—Edward K. Look
*Assistant Examiner*—Kimya N. McCoy
(74) *Attorney, Agent, or Firm*—Nixon & Vanderhye PC

(57) ABSTRACT

A fuel pump for discharging a desired amount of fuel during vapor generation has a pump cover and a pump casing which rotatably accommodates an impeller. A pressure difference is caused in the vicinity of each impeller vane groove by fluid friction as the impeller rotates. Such a pressure difference repeatedly occurs with respect to each of the vane grooves, causing the pressurization of fuel in a pump channel formed along an outer periphery of the impeller to pump fuel to a motor chamber. An introduction groove of the pump channel formed on the pump cover side has a first vapor chamber outwardly extending in the radial direction of the impeller. Another pump channel introduction groove formed on the pump casing side has a second vapor chamber above the impeller. The first and second vapor chambers permit the removal of vapor in fuel fed from the fuel suction port.

22 Claims, 4 Drawing Sheets

FUEL PUMP

CROSS REFERENCE TO RELATED APPLICATION

This application is based on Japanese Patent Application No. 2001-78095 filed on Mar. 19, 2001, the contents of which are incorporated herein by reference.

BACKGROUND OF THE INVENTION

1. Field of the Invention

The present invention relates to a fuel pump for supplying fuel from a fuel tank to an internal combustion engine for an automobile and the like. More specifically, the invention relates to reducing and eliminating vapor in the fuel from effecting a flow rate of the fuel.

2. Description of Related Art

In general, fuel pumps for pressurizing and pumping fuel to engines are known in the art. Among them, for example, is one disclosed in Japanese Patent No. 2757646 (corresponding to Koyama et al., U.S. Pat. No. 5,336,045 published on Aug. 9, 1994), which is a fuel pump for pressurizing and pumping fuel to an engine by drawing fuel from a fuel tank and delivering it to a pump channel formed along an outer periphery of an impeller by rotary motion of the impeller. The fuel in each vane groove formed on the outer periphery of the impeller is fed in the impeller's direction of rotation by rotary motion of the impeller, resulting in fuel pressurization within the pump channel.

In this case, however, vapor may generate in the fuel as a result of an increase in fuel temperature. Consequently, the vapor passes into the vane grooves of the impeller, which hampers the fuel flow rate and subsequently decreases the volume of fuel being discharged from the fuel pump. In addition to the increase in fuel temperature, the drastic change in the flow rate of fuel at the time of drawing fuel from the fuel tank to the pump channel facilitates the generation of vapor in the fuel.

In view of the above-described disadvantages of the prior art, it is an object of the present invention to provide a fuel pump capable of discharging a desired amount of fuel even during the generation of vapor in the fuel. It is another object of the present invention to provide a fuel pump capable of decreasing the generation of vapor. It is still another object of the present invention to provide a fuel pump capable of discharging any vapor being generated.

SUMMARY OF THE INVENTION

In order to solve the above problems, the present invention adopts a technical fuel pump feature. That is, an introduction groove of a pump channel has a first vapor chamber formed on a fuel suction port side of the opposite side of a disk-shaped impeller. The first vapor chamber extends outwardly in a radial direction of the impeller. Accordingly, vapor can escape into the first vapor chamber positioned on the outside of the impeller in its radial direction even though the generation of vapor in the fuel within an introduction groove is caused by the rapid change in the flow rate of drawn fuel or the increase in the temperature of fuel. In other words, the introduction of vapor into vane grooves of the impeller can be prevented, allowing a desired discharge amount of fuel by rotary motion of the impeller.

Here, the depth of an introduction groove may be made large, so that a sufficient volume within the pump channel will discharge the desired amount of fuel. An inner wall of a flow channel component may have a curved or tapered surface at a portion where the fuel suction port and the introduction groove communicate with each other, and the depth of the introduction groove is positioned on the fuel suction port side of opposite sides of the impeller and gradually becomes smaller in a rotary direction of the impeller. Accordingly, the fuel drawn from the fuel suction port can be smoothly fed into the introduction groove, so that a rapid change in the flow rate of fuel does not occur. This permits a decrease in the amount of fuel vapor generated and running into the introduction groove.

The introduction groove may have a second vapor chamber formed on the other of the opposite side of the impeller that is on a far side of the impeller from the fuel suction port. The second vapor port extends to a vicinity of an inlet port of the pressurizing groove. The remainder of vapor, which cannot be trapped in the first vapor chamber, can be accumulated in the second chamber positioned above the impeller. Thus, the introduction of vapor into vane grooves of the impeller can be prevented, allowing the discharge of the desired amount of fuel by a rotary motion of the impeller.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

Figure 1A:
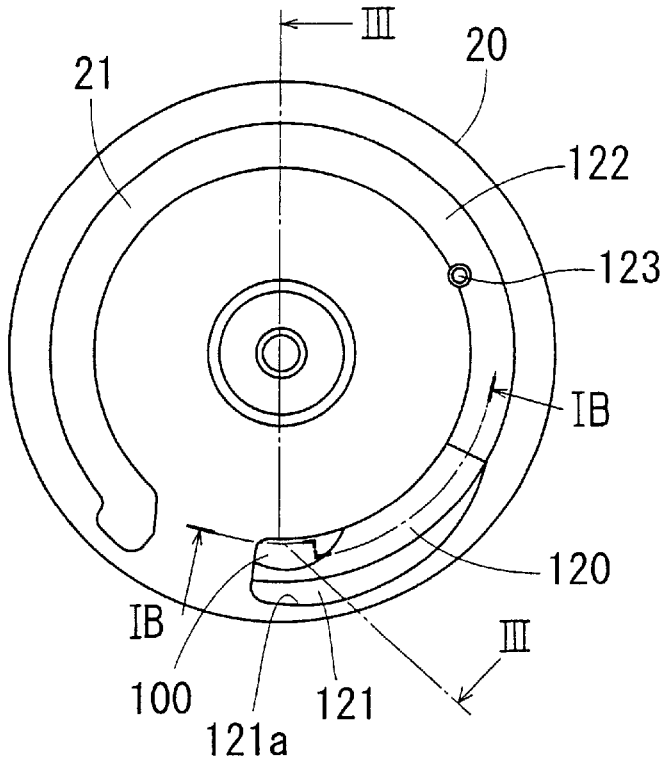
FIG. 1A is a top view of a pump cover, as viewed from a pump casing.

The following description of the preferred embodiment(s) is merely exemplary in nature and is in no way intended to limit the invention, its application, or uses.

Referring now to FIG. 1A through FIG. 4, there is shown a fuel pump in an embodiment of the present invention. In FIGS. 1A, 1B, 2A, and 2B an impeller 43 (FIGS. 3 and 4) is omitted to simplify the illustration. A fuel pump 1 (FIG. 4) is an actuator of an in-tank type fuel pump that is submersible within the fuel of a fuel tank of an automobile or the like. The fuel pump 1 comprises a pump section accommodated in a housing 11, a pump cover 20, and a discharge case 50. The pump cover 20 and the discharge case 50 are swaged together with the housing 11.

The fuel pump 1 further comprises a pump casing 30, and the pump cover 20 and the pump casing 30 make up a flow channel component. Also, there is a C-shaped pump channel 110 between the pump cover 20 and the pump casing 30. Furthermore, an impeller 43 is provided for pressurizing fuel. The impeller 43 is rotatably accommodated in a space above the pump cover 20 and below the pump casing 30.

A plurality of vane grooves is formed on an outer periphery of the disk-shaped impeller 43. When the impeller 43 is rotated together with a rotor 40 described below, a pressure difference is caused in the vicinity of each vane groove by means of fluid friction. Such a pressure difference repeatedly occurs with respect to each of the vane grooves, causing fuel pressurization in the pump channel 110. Therefore, the fuel introduced into the pump channel 110 from a fuel suction port 100 formed on the pump cover 20 is pressurized by a rotary motion of the impeller 43 and is then pumped to a motor chamber 101.

Figure 1B:
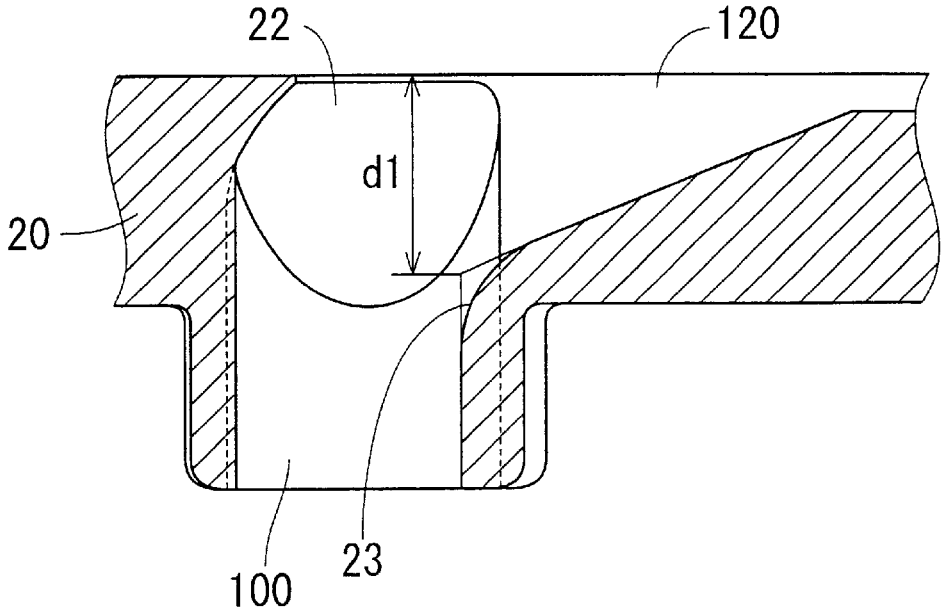
FIG. 1B is a partial cross-sectional view of the pump cover, taken along a line IB—IB of FIG. 1A.
Figure 3:
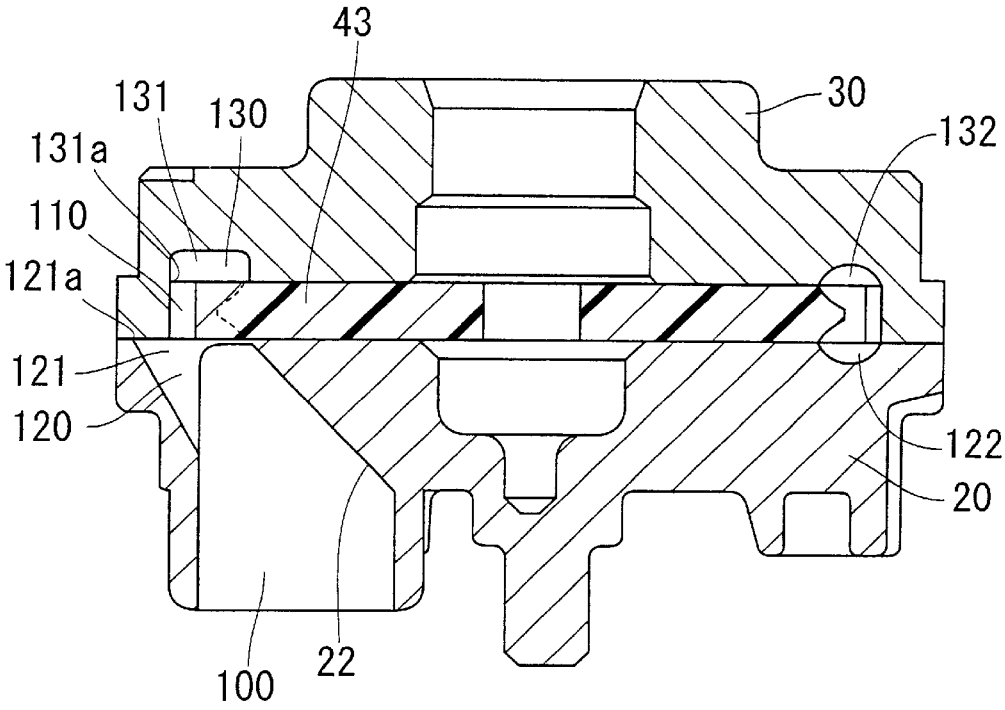
FIG. 3 is a partial cross-sectional view of the pump cover, the pump casing, and an impeller, taken along line IB—IB of FIG. 1A and line IIB—IIB of FIG. 2A, respectively.

As shown in FIGS. 1A and 1B, the pump cover 20 is formed with a C-shaped fuel groove 21 on the surface opposite to the pump casing 30 (not shown in 1A and 1B). The pump channel 110 formed on the side of the pump cover 20 with the fuel groove 21 includes an introduction groove 120 and a pressurizing groove 122. The introduction groove 120 becomes smaller in width and depth from a position opened to the fuel suction port 100. As shown in FIG. 3, the introduction groove 120 has a first vapor chamber 121 that extends outward in the radial direction of the impeller 43. The outer periphery 121*a* of the first vapor chamber 121 is formed on the outside of the impeller 43 from an outer periphery 131*a* of a second vapor chamber 131 (described below) in the radial direction of the impeller 43.

The pressurizing groove 122 is formed continuously from the introduction groove 120, and a fuel vapor vent hole 123 is formed on the inner side of the pressurizing groove 122. The vent hole 123 is opened through the pump cover 20 to permit communication between the pressurizing groove 122 and the inside of a fuel tank on the outside of the fuel pump 1. The vent hole 123 is for discharging air bubbles from the pump channel 110 to the fuel tank. The air bubbles include fuel vapor generated from the pump channel 110.

As shown in FIG. 1B, the inner wall of the pump cover 20 has a tapered surface 22 and a curved surface 23. Also, the introduction groove 120 gradually becomes smaller in depth along the rotary direction of the impeller 43. Therefore, the fuel drawn from the fuel suction port 100 can be smoothly fed to the introduction groove 120. The maximum depth "d1" of the introduction groove 120 is set to 3 to 5 mm at the portion communicated with the fuel suction port 100.

Figure 2A:
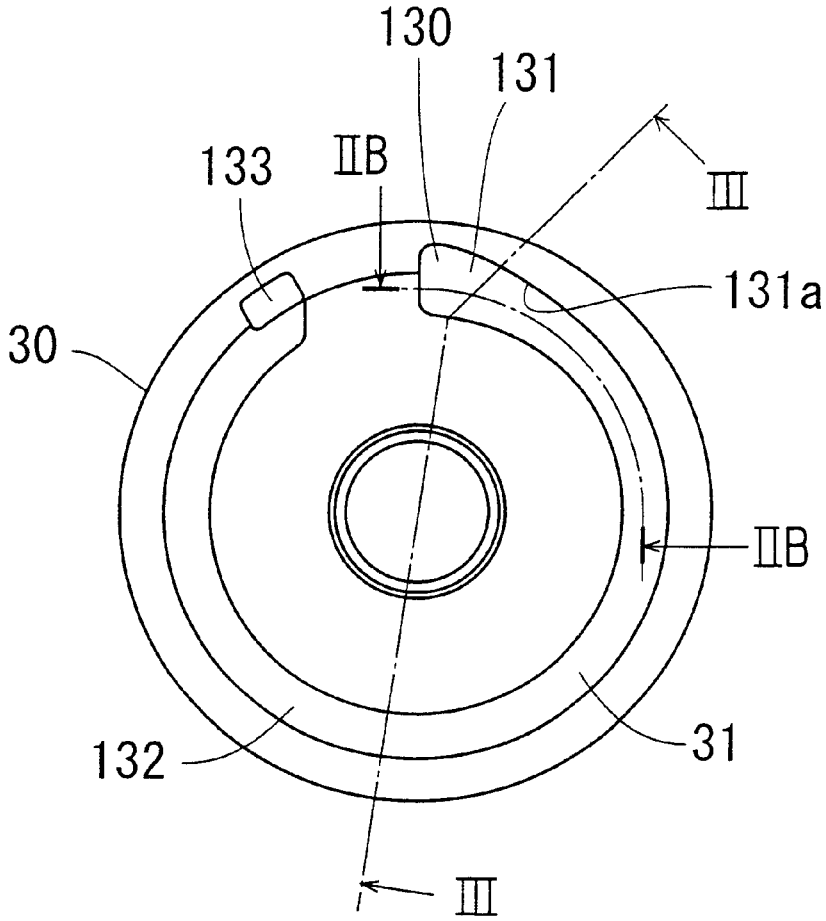
FIG. 2A is a top view of the pump casing, as viewed from the pump cover.
Figure 2B:
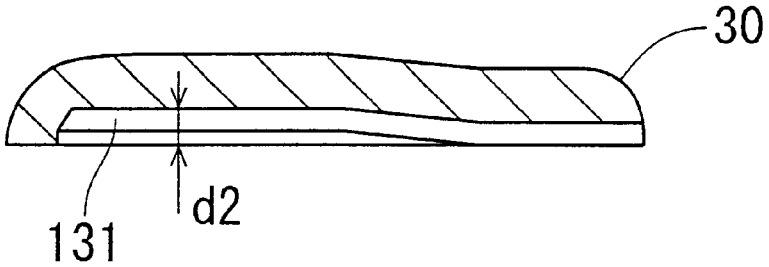
FIG. 2B is a partial cross-sectional view of the pump casing, taken along a line IIB—IIB of FIG. 2A.

As shown in FIGS. 2A and 2B, the pump casing 30 is formed with a C-shaped fuel groove 31 on the surface opposite to the pump cover 20. The pump channel 110 formed on the side of the pump casing 30 with the fuel groove 31 includes an introduction groove 130 and a pressurizing groove 132. As shown in FIGS. 2A and 2B and FIG. 3, there is a second vapor chamber 131 arranged on one side of the two-sided impeller 43, that is, the side farthest from the fuel suction port 100. Therefore, the second vapor chamber 131 is formed above the impeller 43. The depth "d2" of the introduction groove 130 having the second vapor chamber 131 is defined in the range of 0.9 mm to 1.4 mm, so that the pressurizing groove 132 can be smoothly connected therewith without irregularities. In addition, a fuel discharge port 133 is formed on a terminal end portion of the pressurizing groove 132 in the rotary direction of the impeller 43. The fuel discharge port 133 is formed through the pump casing 30 to permit communication between the pressurizing groove 132 and the motor chamber 101.

Figure 4:
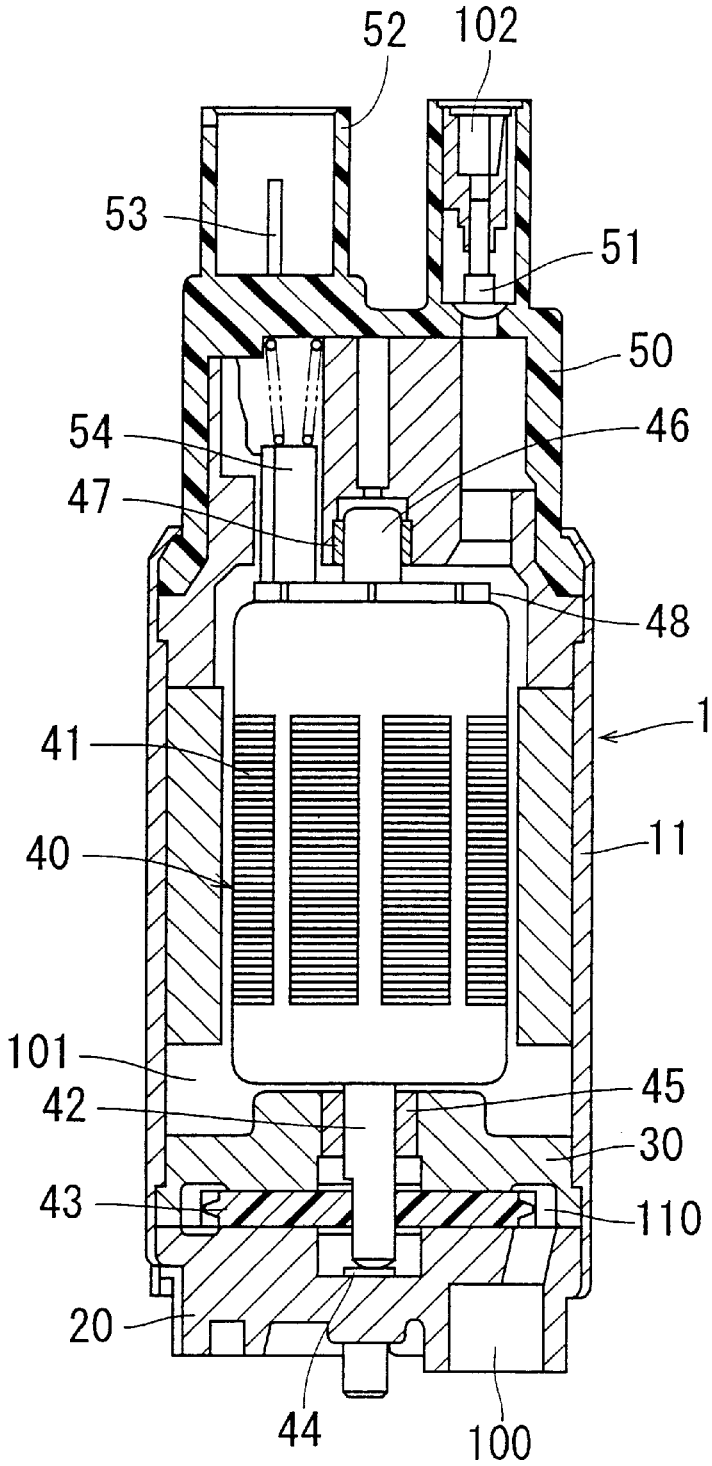
FIG. 4 is a cross-sectional view of a fuel pump to which an embodiment of the present invention is applied.

A permanent magnet is arranged on the outer periphery of the rotor 40 shown in FIG. 4. Therefore, the supply of current to a coil 41 of the rotor 40 can be attained from the outside through a connector pin 53 of an electric connector 52, imparting a rotary motion to the rotor 40. As shown, the rotor 40 has opposite shafts 42, 46 extending in opposite, but coincident directions from the center of the rotor, respectively. The shaft 42 of the rotor 40 on the thrust side is supported by a thrust bearing 44 press-fitted in a central depressed portion of the pump cover 20. In other words, a load in the axial direction of the shaft 42 is supported by the thrust bearing 44 and a load in the radial direction thereof is also supported by another bearing 45. As shown in the figure, furthermore, there is an axial cut portion formed on the outer periphery of the shaft 42, so that the impeller 43 can be fixed on the cut portion of the shaft 42. On the other hand, shaft 46 of the rotor 40 is supported by a bearing 47 in the radial direction. In addition, there is a commutator 48 on the same side of the shaft 46 as the rotor 40.

The discharge case 50 is swaged with the other end of the housing 11 and includes a check valve 51 accommodated within a discharge port 102. The check valve 51 acts to prevent the counter flow of fuel discharged from the discharge port 102. The connector pin 53 is housed within the elector connector 52 formed on the discharge case 50, while the connector pin 53 is connected to the coil 41 of the rotor 40 through a brush 54 and commutator 48.

Next, the action of the fuel pump 1 will be described. When the impeller 43 begins its rotary motion, the vicinity of the fuel suction port 100 experiences negative pressure and draws fuel from the fuel tank. As the fuel suction port 100 experiences negative pressure, vapor tends to be generated in the fuel drawn from the fuel tank into the fuel suction port 100. If the fuel temperature increases, vapor generation may more easily occur in the fuel.

At a position of communication between the fuel suction port 100 and the introduction groove 120, as the inner wall of the pump cover 20 has both the tapered surface 22 and the curved surface 23, the fuel drawn from the fuel suction port 100 can be smoothly fed into the introduction groove 120. Therefore, a change in flow rate of fuel introduced from the fuel suction port 100 into the introduction groove 120 is gradual, so that fuel vapors generated in the fuel introduced from the fuel suction port 100 into the introduction groove 120 may be substantially decreased. In addition, even though fuel vapor is generated in fuel in the introduction groove 120, the fuel vapor can be released into the first vapor chamber 121 which outwardly extends in the radial direction of the impeller 43. Consequently, the resulting vapor can be prevented from flowing into the vane grooves of the impeller 43. Furthermore, the vapor remaining after releasing it into the first vapor chamber 121 can be further released into the second vapor chamber 131 positioned above the impeller 43, with reference to FIGS. 3 and 4. Therefore, the resulting vapor can be prevented from flowing into the vane grooves of the impeller 43.

The fuel introduced from the fuel suction port 100 into the introduction groove 110 can be pressurized by the pressurizing grooves 122, 132 without interference of vapor, so that the desired volume of fuel can be discharged by the fuel pump 1. To such an extent that the vapor does not prevent the pressurizing action of the impeller 43, the vapor that escapes into the first and second chambers 121, 131 is permitted to flow through the pump channel 110 and into the pressurizing groove 122 with rotary motion of the impeller 43 and discharged from the vapor vent hole 123 to an exterior of the fuel pump 1.

According to the present invention, even though vapor is generated as the fuel temperature increases, the first and second vapor chambers 121, 131 will extract the vapor from the fuel, so the resulting vapor is prevented from flowing into the vane grooves of the impeller 43. In addition, at the communicating location between the fuel suction port 100 and the introduction groove 120, where a change in the direction of fuel flow occurs, since the inner wall of the pump cover 20 has the tapered surface 22 and the curved surface 23, the fuel drawn from the fuel suction port 100 is smoothly fed into the introduction groove 120. Therefore, a sudden flow rate change of fuel running into the introduction groove 120 from the fuel suction port 100 is prevented.

According to the present invention, therefore, the fuel pump is designed to reduce or eliminate vapor generation in a fuel and also to direct vapor into the first and second vapor chambers 121, 131 which does not decrease the pressurizing activity of the impeller 43 even though there is a generation of vapor.

Figure 5:
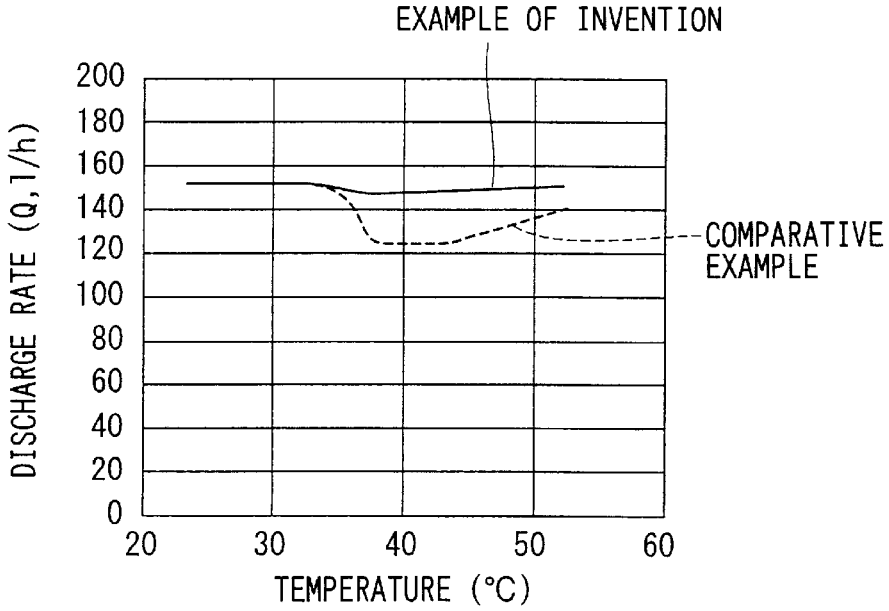
FIG. 5 is a graph showing relationships between flow rates and temperatures according to an example of the invention and a comparative example.

Referring now to FIG. 5, there is a graph showing fuel discharging rate changes when the above-described fuel pump is driven during fuel supply within a range of fuel temperatures. In this embodiment, as illustrated by the solid line in the graph, the discharging rate is hardly reduced even when the fuel temperature exceeds approximately 35° C. Therefore, a high fuel discharge rate is maintained. However, when compared to a conventional fuel pump that is not similar to embodiments of the present invention, the fuel discharging rate is largely reduced when the fuel temperature exceeds approximately 35° C. as illustrated by the dashed line. Consequently, compared with the conventional fuel pump, the fuel pump of the present embodiment does not undergo a reduction in fuel discharge volume at high temperatures and allows the discharge of fuel at a desired volume.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel pump for pressurizing and pumping fuel drawn from a fuel tank, the fuel pump comprising:

a disk-shaped impeller within a flow channel, the impeller capable of rotating within the flow channel, a fuel suction port, a pump channel defined along an outer periphery of the impeller for pressurizing fuel drawn from the fuel suction port by rotary motion of the impeller, and a first vapor chamber formed on a fuel suction port side of the impeller and formed in a radial direction of the impeller, said first vapor chamber being defined radially outside an outer periphery of said pump channel, wherein the pump channel includes an introduction groove in fluid communication with the fuel suction port and a pressurizing groove continuously formed with the introduction groove for pressurizing fuel by rotary motion of the impeller.

2. A fuel pump according to claim 1, wherein the introduction groove defines a first depth positioned on the fuel suction port side of the impeller.

3. A fuel pump according to claim 2, wherein an inner wall of the flow channel has at least one of a curved surface and a tapered surface at a portion where the fuel suction port and the introduction groove fluidly communicate with each other, and the depth of the introduction groove positioned on the fuel suction port side of the impeller gradually becomes narrower in a direction of rotation of the impeller.

4. A fuel pump according to claim 3, wherein the introduction groove defines a second vapor chamber formed on a second side of the impeller which is opposite the fuel suction port, the second vapor chamber extending to the pressurizing groove.

5. A fuel pump according to claim 2, wherein the introduction groove defines a second vapor chamber formed on a second side of the impeller which is opposite the fuel suction port, the second vapor chamber extending to the pressurizing groove.

6. A fuel pump according to claim 1, wherein an inner wall of the flow channel has at least one of a curved surface and a tapered surface at a portion where the fuel suction port and the introduction groove fluidly communicate with each other, and the depth of the introduction groove positioned on the fuel suction port side of the impeller gradually becomes narrower in a direction of rotation of the impeller.

7. A fuel pump according to claim 6, wherein the introduction groove defines a second vapor chamber formed on a second side of the impeller which is opposite the fuel suction port, the second vapor chamber extending to the pressurizing groove.

8. A fuel pump according to claim 1, wherein the introduction groove defines a second vapor chamber formed on a second side of the impeller which is opposite the fuel suction port, the second vapor chamber extending to the pressurizing groove.

9. A fuel pump for pressurizing and pumping fuel drawn from a fuel tank, the fuel pump comprising:

a pump casing defining a recess;

a pump cover that abuts the pump casing thereby defining a flow channel therebetween; and an impeller for rotating within the flow channel, wherein the impeller defines a first tapered surface and a second tapered surface around its outer periphery, the tapered surfaces forming part of a pump channel at the outer periphery of the impeller, the pump channel being used for pressurizing fuel drawn by rotary motion of the impeller, wherein said pump cover further defines a first vapor chamber on a fuel suction port side of the impeller and in a radial direction of the impeller, said first vapor chamber being defined radially outside an outer periphery of said puma channel.

10. The fuel pump according to claim 9, wherein the pump cover defines a first introduction groove and a fuel suction port in fluid communication with each other to transfer fuel to the pump channel.

11. The fuel pump according to claim 10, wherein the pump cover also defines a fuel pressurizing groove continuously formed with the first introduction groove for pressurizing fuel by rotary motion of the impeller.

12. The fuel pump according to claim 11, wherein from the fuel suction port, a depth of the first introduction groove is greater than a depth of the pressurizing groove.

13. The fuel pump according to claim 12, wherein the pump cover further defines a fuel vapor vent hole for transferring fuel vapor.

14. The fuel pump according to claim 13, wherein the pump casing defines a second introduction groove and a second vapor channel, the second vapor channel extending to a vicinity of a fuel discharge port defined in the pump casing, the second vapor channel further defining a pressurizing groove.

15. A fuel pump for pressurizing and pumping fuel drawn from a fuel tank, the fuel pump comprising:

a disk-shaped impeller within a flow channel, the impeller capable of rotating within the flow channel, a fuel suction port and a pump channel defined along an outer periphery of the impeller for pressurizing fuel drawn from the fuel suction port by rotary motion of the impeller, wherein the pump channel defines an introduction groove in fluid communication with the fuel suction port and also includes defines a pressurizing groove continuously formed with the introduction groove for pressurizing fuel by rotary motion of the impeller, the introduction groove defining a first vapor chamber formed on a fuel suction port side of the impeller and formed in a radial direction of the impeller beyond the pump channel, and wherein an outer peripheral side of the first vapor chamber is covered with a pump casing.

16. A fuel pump according to claim 15, wherein the introduction groove defines a second vapor chamber formed on a second side of the impeller which is opposite the fuel suction port, the second vapor chamber extending to the pressurizing groove.

17. A fuel pump for pressurizing and pumping fuel drawn from a fuel tank, the fuel pump comprising:

a pump casing having a recess defined therein;

a pump cover defining a fuel suction port, a first introduction groove and a fuel pressurizing groove continuously formed with the first introduction groove whereby when said pump cover and said pump casing are disposed in face to face abutting relation a flow channel is defined therebetween;

an impeller for rotating within the flow channel; and a pump channel defined along an outer periphery of the impeller for pressurizing fuel drawn from the fuel suction port;

wherein the pump cover further defines a first vapor chamber formed on a fuel suction port side of the impeller and formed in a radial direction of the impeller, said first vapor chamber being defined radially outside an outer periphery of said pump channel; and wherein an outer periphery of the first vapor chamber is covered by said pump casing so that the first vapor chamber extends radially beyond the pump channel.

18. A fuel pump according to claim 17, wherein the impeller defines a first tapered surface and a second tapered surface around its outer periphery, the tapered surfaces forming in part of said pump channel at the outer periphery of the impeller.

19. The fuel pump according to claim 17, wherein from the fuel suction port, a depth of the first introduction groove is greater than a depth of the pressurizing groove.

20. The fuel pump according to claim 17, wherein the pump cover further defines a fuel vapor vent hole for transferring fuel vapor.

21. The fuel pump according to claim 17, wherein the pump casing defines a second introduction groove and a second vapor channel, the second vapor channel extending to a vicinity of a fuel discharge port defined in the pump casing, the second vapor channel further defining a pressurizing groove.

22. A fuel pump according to claim 17, wherein the introduction groove defines a second vapor chamber formed on a second side of the impeller which is opposite the fuel suction port, said second vapor chamber extending axially beyond said impeller a distance greater than an axial extent of said pressurizing groove into the pump casing.

* * * * *